US005275574A

United States Patent [19]

Schlothauer et al.

[11] Patent Number: 5,275,574

[45] Date of Patent: Jan. 4, 1994

[54] CONVERTIBLE PLUG

[76] Inventors: Lee M. Schlothauer, 504 Granite Ct., Gillette, Wyo. 82716; George Spector, 233 Broadway, RM 702, New York, N.Y. 10279

[21] Appl. No.: 991,417

[22] Filed: Dec. 16, 1992

[51] Int. Cl.[5] ..... H01R 29/00

[52] U.S. Cl. ..... 439/171; 439/174

[58] Field of Search ..... 439/166, 170-174, 439/217-221, 650-655, 502, 505, 369, 371

[56] References Cited

U.S. PATENT DOCUMENTS

| | | | |
|---|---|---|---|
| 3,049,688 | 8/1962 | Sinopoli | 439/650 |
| 3,585,569 | 6/1971 | Moran | 439/371 |
| 4,033,658 | 7/1977 | Asick | 439/218 |
| 5,026,300 | 6/1991 | Varner | 439/371 |

FOREIGN PATENT DOCUMENTS

| | | | |
|---|---|---|---|
| 270724 | 12/1960 | Australia | 439/171 |

*Primary Examiner*—David L. Pirlot

[57] ABSTRACT

An improved electrical extension cord is provided which consists of an elongated power cord with a male plug connected to a first end of the power cord. The male plug has a flat housing and a pair of side entry prongs, so that it can be positioned closer to an electrical outlet that is behind a major piece of furniture. A female socket is connected to a second end of the power cord. The female socket has a flat housing and a plurality of side entry slots. A mechanism is for fastening the flat housing of the female socket in one instance to a baseboard and in a second instance to a side of the major piece of furniture, to make the female socket accessible, so it can be utilized.

2 Claims, 1 Drawing Sheet

CONVERTIBLE PLUG

SUMMARY OF THE INVENTION

A primary object of the present invention is to provide an improved electrical extension cord that will overcome the shortcomings of the prior art devices.

Another object is to provide an improved electrical extension cord, in which the male plug is so shaped that it contains side entry prongs, so as to be positioned closed to an electrical outlet behind a major piece of furniture.

An additional object is to provide an improved electrical extension cord, in which the female socket has a flat back in which VELCRO is applied, so that it can be attached to a baseboard or to the side of the major piece of furniture to make the female socket accessible.

A further object is to provide an improved electrical extension cord that is simple and easy to use.

A still further object is to provide an improved electrical extension cord that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
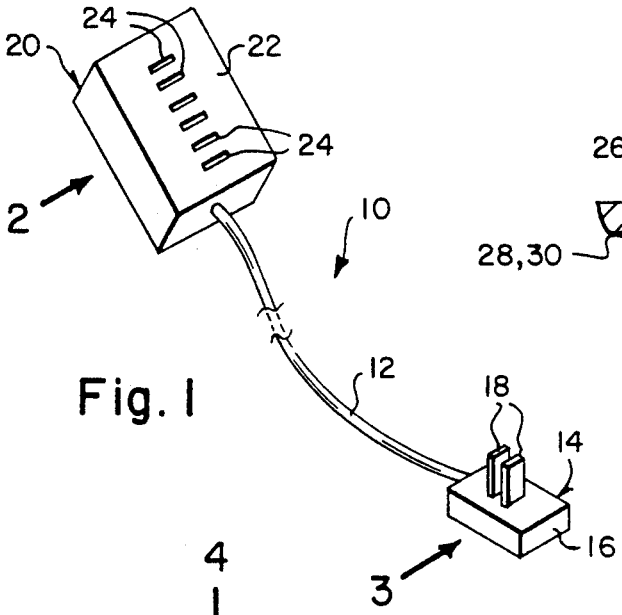
FIG. 1 is a perspective view of the instant invention.
Figure 2:
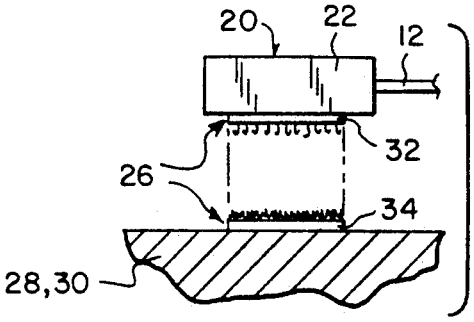
FIG. 2 is an exploded side view taken in direction of arrow 2 in FIG. 1, showing the hook and loop pile fabric fastener pad between the female socket and a flat surface.

Turning now descriptively to the drawings, in which similar reference characters denote similar elements throughout the several views, the Figures illustrate an improved electrical extension cord 10, which consists of an elongated power cord 12 with a male plug 14 connected to a first end of the power cord 12. The male plug 14 has a flat housing 16 and a pair of side entry prongs 18, so that it can be positioned closer to an electrical outlet that is behind a major piece of furniture (not shown). A female socket 20 is connected to a second end of the power cord 12. The female socket 20 has a flat housing 22 and a plurality of side entry slots 24. A mechanism 26 is for fastening the flat housing 22 of the female socket 2 in one instance to a baseboard 28 and in a second instance to a side 30 of the major piece of furniture to make the female socket 22 accessible, so it can be utilized.

The fastening mechanism 26 is a hook and loop fabric fastener pad, in which a first portion 32 is attached to the flat housing 22 of the female socket 20 opposite from the side entry slots 24. A second portion 34 is attached to the baseboard 28 of the side 30 of the major piece of furniture.

Figure 3:
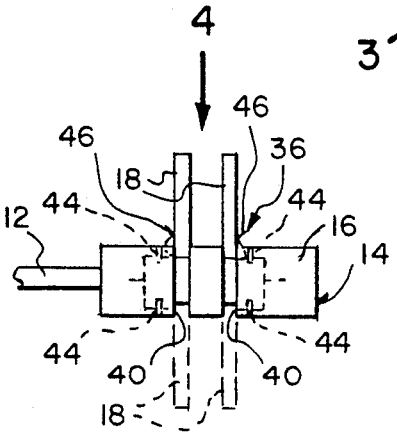
FIG. 3 is a side view taken in direction of arrow 3 in FIG. 1, showing a modification in which the prongs in the male plug are slideable within tracks.
Figure 4:
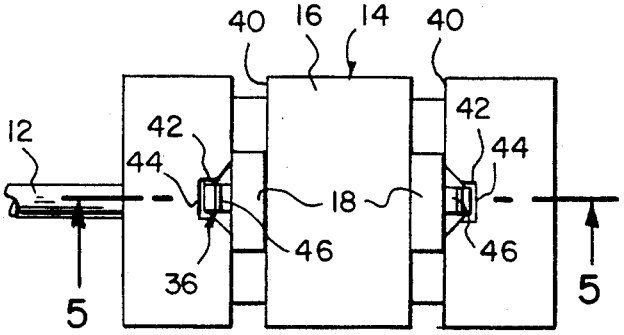
FIG. 4 is an enlarged top view taken in direction of arrow 4 in FIG. 3, showing the stop contacts within the tracks.
Figure 5:
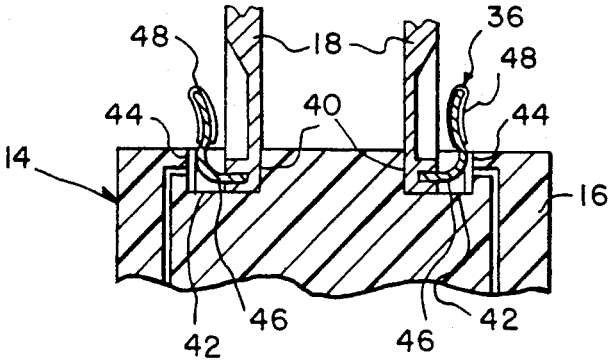
FIG. 5 is a cross sectional view taken along line 5—5 in FIG. 4, showing the internal stop contacts in greater detail.

As shown in FIGS. 3, 4 and the male plug 14 further contains a structure 36 for moving the side entry prongs 18 to an opposite side of the flat housing 16. The moving structure 36 includes the flat housing 16 having a pair of parallel tracks 40 formed thereabout. Each track 40 has a stop recess position 42 located on opposite sides thereof, in which two stop recess positions 42 on each side being aligned between the tracks 40. Four electrical contact pins 44, are provided with each located within one stop recess position 42. Each prong 18 has a spring biased contact member 46 attached thereto, which can slide within one of the tracks 40, until the spring biased contact member 46 engages with one of the two electrical contact pins 44. Two insulated cover 48 can also be provided, with each fitting over the top of one contact member 46. A person can grip the covers 48 to squeeze the contact members 46 towards the prongs 18, to release the contact members 46 from the respective stop recess positions 44.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved electrical extension cord which comprises:

a) an elongated power cord;

b) a male plug connected to a first end of said power cord said male plug having a flat housing and a parallel pair of side entry prongs located at a first position, so that it can be positioned closer to an electrical outlet that is behind a major piece of furniture;

c) a female socket connected to a second end of said power cord, said female socket having a flat housing and a plurality of side entry slots; and d) means for fastening said flat housing of said female socket in one instance to a baseboard and in a second instance to a side of the major piece of furniture, to make said female socket accessible, so it can be utilized; wherein said fastening means is a hook and loop fabric fastener pad, in which a first portion is attached to said flat housing of said female socket opposite from said side entry slots and a second portion is attached to the baseboard of the side of the major piece of furniture; wherein said male plug further includes means for moving said side entry prongs about said male plug housing to a second position at an opposite side of said male plug flat housing; wherein said prongs are in parallel alignment with each other transversely and each said prong is in longitudinal alignment with each corresponding prong when in the first position.

2. An improved electrical extension cord as recited in claim 1, wherein said moving means includes:

a) said male plug flat housing having a pair of parallel tracks formed thereabout, with each said track having a stop recess said second position located on opposite sides thereof, in which said two stop recess second positions on each side being aligned between said tracks;

b) four electrical contact pins, each located within one of said stop recess second positions;

c) each said prong having a spring biased contact member attached thereto, which can slide within one of said tracks, until said spring biased contact member engages with one of said two electrical contact pins therein; and d) two insulated covers, each to fit over the top of one said contact member, so that a person can grip said covers to squeeze said contact members towards said prongs to release said contact members from said respective stop recess second positions.

* * * * *